US005511803A

United States Patent [19]

Klukos

[11] Patent Number: 5,511,803

[45] Date of Patent: Apr. 30, 1996

[54] BRAKE FOR ROLLER SKATES

[76] Inventor: Edward O. Klukos, 10030 152nd Ave., West Olive, Mich. 49460

[21] Appl. No.: 302,046

[22] Filed: Sep. 7, 1994

[51] Int. Cl.[6] ..... A63C 17/14

[52] U.S. Cl. ..... 280/11.2; 188/4 B

[58] Field of Search ..... 188/4 B, 5, 29; 280/11.2, 11.22, 11.27

[56] References Cited

U.S. PATENT DOCUMENTS

| | | | |
|---|---|---|---|
| 968,427 | 8/1910 | Simon | 280/11.2 |
| 2,027,487 | 1/1936 | Means . | |
| 2,644,692 | 7/1953 | Kahlert | 280/11.2 X |
| 3,224,785 | 12/1965 | Stevenson . | |
| 4,088,334 | 5/1978 | Johnson . | |
| 4,275,895 | 6/1981 | Edwards . | |
| 4,402,520 | 9/1983 | Ziegler . | |
| 4,453,726 | 6/1984 | Ziegler . | |
| 5,052,701 | 10/1991 | Olson . | |
| 5,088,748 | 2/1992 | Koselka et al. . | |
| 5,135,244 | 8/1992 | Allison . | |
| 5,183,275 | 2/1993 | Hoskin . | |
| 5,192,099 | 3/1993 | Riutta . | |
| 5,232,231 | 8/1993 | Carlsmith . | |

OTHER PUBLICATIONS

Exhibit A is a product brochure entitled "Bravoblade" published by Rollerblade, Inc., of Minnetonka, Minn., copyright 1993, disclosing an in–line roller skate including a cuff–actuated brake.

Exhit B is a product brochure entitled "Roller Stop" published by Roller Stop Inc., Malden, Md., publication date unknown, disclosing an in–line roller skate inculding a retrofittable brake system.

Exhibit C is a product brochure entitled "Grip In–Line Speed Control" published by Grip Inc., Boulder, Co., publication date unknown (but post marked as mailed Nov., 1993), disclosing an in–line roller skate including a cable–operated remote–actuated braking system.

Exhibit D is a product brochure entitled "1994 Oxygen Inline Skates" published by Atomic for Sport, Amherst, New Hampshire, publication date unknown, disclosing an in–line roller skate including a power braking system.

Exhibit E is an article entitled "Brake Wars In Chicago" published in the magazine Inline Retailer & Industry News, vol. 3, Issue 5, Aug. 15, 1994, on the cover page and page 19, which discloses three brake mechanisms, at least one of which includes a roller brake and a spring loaded disc brake.

*Primary Examiner*—Karin L. Tyson
*Assistant Examiner*—Michael Mar
*Attorney, Agent, or Firm*—Price, Heneveld, Cooper, DeWitt & Litton

[57] ABSTRACT

A braking system is provided for an in-line roller skate for skating on hard skate-supporting surfaces. The roller skate includes a shoe, a wheel-supporting frame attached to the shoe, and a plurality of aligned wheels operably supported by the wheel-supporting frame. The braking system includes an extension connected to the wheel-supporting frame including a pair of opposing flanges, a brake pad operably supported on the extension, and a braking wheel positioned generally in alignment with and behind the plurality of aligned wheels. The braking system further includes an axle rotatably supporting the braking wheel. The axle is supported on the extension by a support mechanism for sliding movement between various braking positions such that, as the braking wheel engages the hard surface with increasing force, the braking wheel moves toward the braking pad and generates increasing braking force. Various support mechanisms for slideably supporting the braking wheel are disclosed.

26 Claims, 7 Drawing Sheets

BRAKE FOR ROLLER SKATES

BACKGROUND OF THE INVENTION

This invention relates to roller skates, and more particularly relates to a brake for roller skates.

Skaters using in-line roller skates must be able to safely stop or slow down regardless of their expertise, and further must always be "in control" so that they do not risk running into other skaters or bystanders. Beginners in particular have problems as they are learning to skate due to the free running nature of roller skates. However, more experienced skaters also desire fine levels of control to facilitate quick turns and stops. A number of roller skate brakes have been constructed for these purposes. However, known roller skate brakes have several problems as noted below.

The most common braking system now used on in-line roller skates includes a wear block attached to a rear of the skate that can be dragged on a skating surface to provide a braking action. However, the wear block rapidly wears away and thus has a limited life. Further, the wear block is subject to catching or hooking on depressions, such as on the edges of or depressions in concrete sections in a sidewalk, such that the user may trip and fall. Still further, a wear block will often pick up small stones that embed themselves in the wear block. These small stones dramatically change the coefficient of friction generated by the wear block as the wear block is dragged on the skating surface, thus causing the brake to provide an uncertain and inconsistent brake force.

Some in-line roller skate brakes apply a braking force to one or more of the "active" weight-supporting wheels on the skate. For example, see U.S. Pat. No. 5,232,231 to Carlsmith. However, if any of these "active" weight-supporting wheels lock up or skid, a flat spot is created on the wheel. This flat spot causes the roller skate to vibrate during use, which is very annoying and also physically tiring. Further, the vibration caused by an "active" wheel having a flat spot takes away tremendously from the enjoyment of skating. Notably, the "active" wheels on the in-line roller skates periodically support less than an equal portion of a person's weight due to unevenness of the skating surface. Thus, it is relatively common for an "active" wheel that is being braked to skid and develop a flat spot. Another problem is that brakes sometimes stick or drag, thus causing a skater to unknowingly expend extra effort when skating.

U.S. Pat. No. 5,183,275 to Hoskin discloses a roller skate brake including a brake pad and a roller for engaging the braking pad. However, the actuating mechanism in Hoskin '275 involves multiple links and a braking wheel that are relatively small and intricate, such that they are mechanically more delicate and expensive to manufacture and assemble than are desired. Further, in Hoskin '275, the braking wheel, in addition to engaging the brake pad, also engages the rear in-line weight bearing wheel on the roller skate, thus leading to the problem of flat spots previously discussed above.

U.S. Pat. No. 5,192,099 to Ruitta discloses a roller skate including a brake pad and a rear skate wheel mounted on flexible side members that flex so that the rear skate wheel can be moved into engagement with the brake pad. The brake pad is adjustable to various fixed positions along a slot to compensate for wheel and brake pad wear. However, the problem of flat spots on wheels is not addressed. Also, the flexibility of the side members brings the durability and mechanical stability of the side members into question since, if the side members are vertically flexible along a "long" side of the cross section, they would tend to permit lateral movement and wandering of the rear wheel.

U.S. Pat. No. 5,088,748 to Koselka et al discloses in FIG. 1 a braking system in which a braking wheel and braking member are pivotally mounted to the roller skate by a four-bar linkage. As a practical matter, the multiple joints in the linkages are difficult to manufacture so that they operate freely yet without sloppiness. Further, even if manufactured properly, the joints are likely to loosen over time. Still further, the braking member operates on the hub of the braking wheel, such that the torque arm is small and the frictional braking force must be quite large in order to generate a desired level of braking torque on the braking wheel. Also, the device lacks adjustability. The embodiments in FIGS. 4 and 5 do not have the four bar linkage, but rather have a pair of trailing arms supporting a braking wheel. However, the braking member operates to brake the rear weight-supporting wheel on the roller skate, thus leading to the problem of flat spots discussed above.

U.S. Pat. Nos. 4,453,726 and 4,402,520 to Ziegler disclose traditional four wheeled roller skates where the wheels are arranged in a rectangular pattern. The roller skates include a braking wheel that Cams pressure elements outwardly against two axially aligned roller wheels. Notably, the camming action tends to force the wheels apart, such that the bearings on the rear skate wheels may need constant maintenance or may fail prematurely. Further, it is noted that major modifications would be required to apply the braking system in Ziegler to an in-line roller skate.

U.S. Pat. No. 4,275,895 to Edwards discloses a cuff-actuated braking system including a brake pad that engages the two rear wheels of a rectangularly arranged, four wheel skate. (See FIG. 3.) Notably, the brake pad engages the rear wheels, and thus flat spots and wheel wear can be a problem. Also, major modifications would be required to apply the braking system in Edwards to an in-line roller skate.

U.S. Pat. No. 2,027,487 to Means discloses a brake pad attached to a flexible support that can be flexed to engage the brake pad with the rear roller skate. In addition to the problems previously discussed relating to rear wheel flat spots and wear, major modification is required to use the device on in-line roller skates.

Aside from the above, the known roller skate brakes do not provide a natural and smooth "feel" to the skater when braking. I have not determined exactly why this is true, but I believe it to be due in part to the multiple joints and flexibility of the parts used in many of the prior art brakes, and the inability of the known constructions to provide a consistent and uniformly increasing braking force that is directly correlated to the amount of force transmitted from the skate-supporting surface to the brake. Also, it is noted that many of the prior art brakes are expensive to manufacture, are expensive to maintain, and also are difficult to adjust and/or keep in adjustment.

Thus, braking systems for in-line roller skates solving the aforementioned problems are desired.

SUMMARY OF THE INVENTION

The present invention includes a braking system for an in-line roller skate that includes a wheel-supporting frame, and a plurality of aligned wheels operably supported by the wheel-supporting frame. The braking system includes an extension connected to the wheel-supporting frame and a braking pad operably supported by the extension. A braking wheel is positioned generally in alignment with the plurality of aligned wheels proximate the braking pad. The braking wheel is positioned to rollingly engage the skate-supporting surface when the roller skate is pivoted rearwardly and is slideably supported on the extension by a support mechanism for movement between various braking positions such that, as the in-line roller skate is tilted rearwardly and the braking wheel engages the skate-supporting surface with increasing force, the braking wheel moves toward the braking pad and generates increasing braking force. In preferred forms, the initial braking force and/or the braking load/displacement curve is adjustable or variable.

These and other advantages and features of the present invention will be further understood by a person of ordinary skill in the art by a review of the attached specification, claims, and appended drawings.

DETAILED DESCRIPTION OF THE PREFERRED EMBODIMENTS

Figure 1:
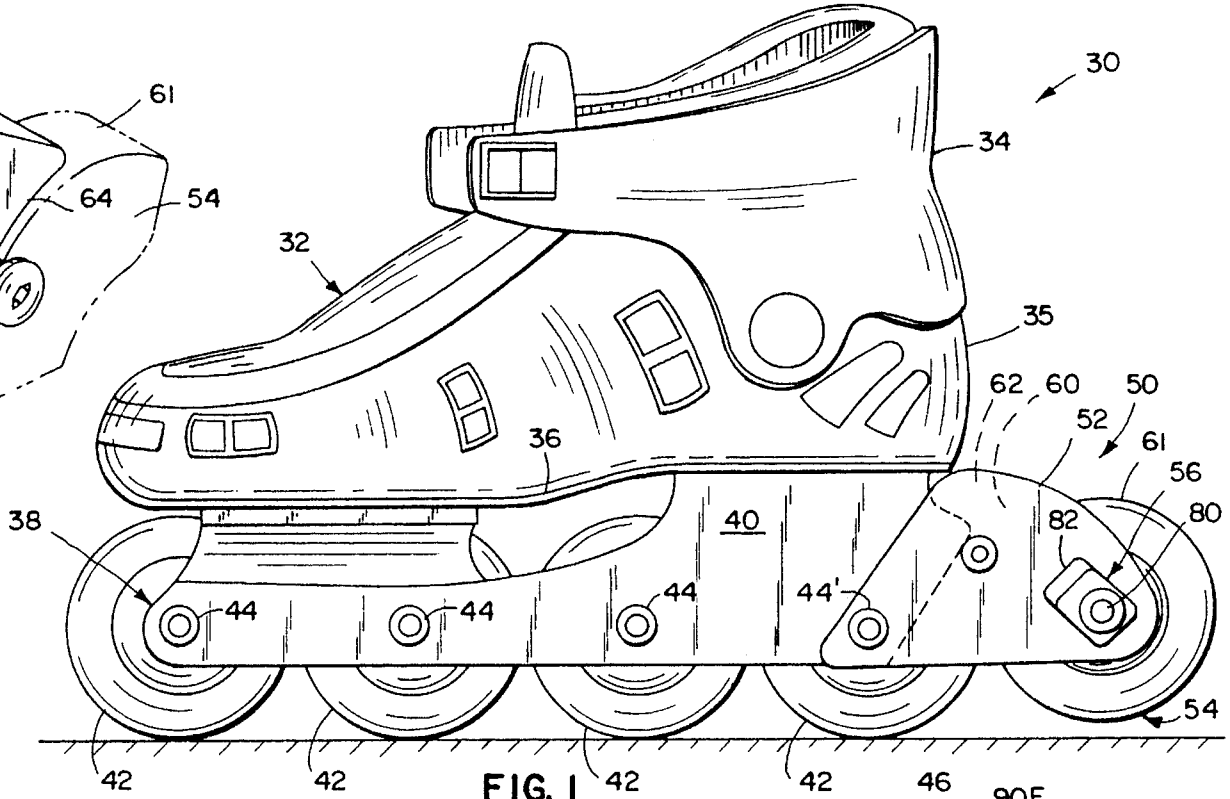
FIG. 1 is a side view of an in-line skate embodying the present invention.
Figure 18:
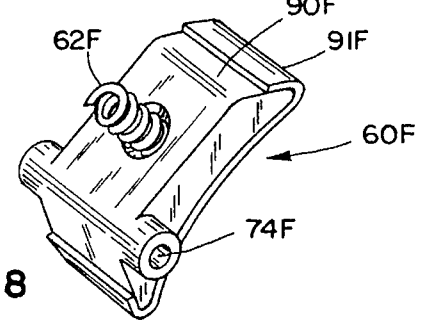
FIG. 18 is a perspective view of, the braking pad shown in FIG. 16.
Figure 5:
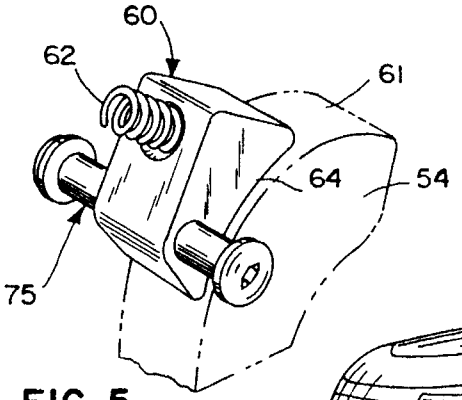
FIG. 5 is a perspective view of the brake pad and pivot pin supporting the brake pad, the braking wheel being shown in phantom and the extension having been removed to better show the arrangement of the brake pad and braking wheel.

An in-line roller skate 30 (FIG. 1) embodying the present invention includes a shoe 32 having a cuff or ankle support 34, a boot 35, and a sole 36. A wheel-supporting frame 38 is attached to the bottom of sole 36. Wheel-supporting frame 38 includes a pair of spaced apart flanges 40 that extend downwardly, and four aligned "active" weight-supporting wheels 42 and 42' (wheel 42' being the rear wheel) are operably secured between flanges 40 on axles 44 by roller bearings (not wheel) are operably secured between flanges 40 on axles 44 by roller bearings (not specifically shown). Wheels 42 and 42' define a vertical plane and the bottom-most points on wheels 42 and 42' are co-linear so that they simultaneously engage a skate-supporting surface 46, such as a cement or pavement covered sidewalk or parking lot. The present invention is focused on the braking system 50 attached to the rear of frame 38.

Braking system 50 (FIG. 1) includes a U-shaped extension 52 fixedly connected to the rear of frame 38. Extension 52 includes slots 82 and 85 for slideably receiving a support mechanism 56. An axle 80 operably rotatably supports a braking wheel 54 on support mechanism 56. A brake pad 60 is adjustably secured to extension 52 proximate the outer upper surface 61 of braking wheel 54, and a spring 62 biases the brake pad 60 against braking wheel 54. As a skater initially pivots skate 30 rearwardly about the rear wheel 42', braking wheel 54 rollingly engages hard surface 46 and rubs against braking surface 64 of braking pad 60 to create an initial predetermined level of braking force. Since the skate-supporting surface 46 is rougher than the brake pad 60, the braking wheel 54 rolls on surface 46 rather then slides or skids. As the skater further pivots rearwardly, skate-supporting surface 46 presses against braking wheel 54 with increased pressure causing slide mechanism 56 to move braking wheel 54 toward brake pad 60, thus increasing the frictional braking force on braking wheel 54.

By adjusting the tension on spring 62 such as by placing spacers under the spring, or by replacing spring 62 with a stronger or weaker spring, the frictional force/displacement curve of brake pad 60 on braking wheel 54 can be selectively preset, both when the spring 62 is fully extended and when spring 62 is partially compressed by movement of braking wheel 54. Thus, the initial braking force and also the load/deflection curve of the brake pad and braking wheel can be controlled for optimal function and performance. Notably, support mechanism 56 can be designed to limit the movement of braking wheel 54 toward brake pad 60 to prevent lock up of braking wheel 54 if desired, such as by designing support mechanism 58 to engage the end of slot 82 before braking wheel 54 engages brake pad 60 with a lock up force.

Figure 3:
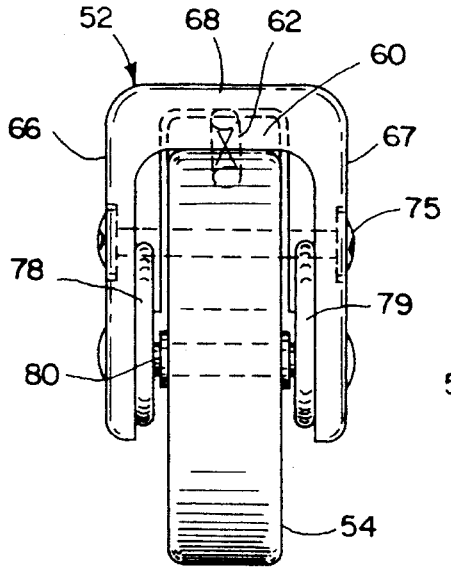
FIG. 3 is a rear end view of the braking system shown in FIG. 2.
Figure 4:
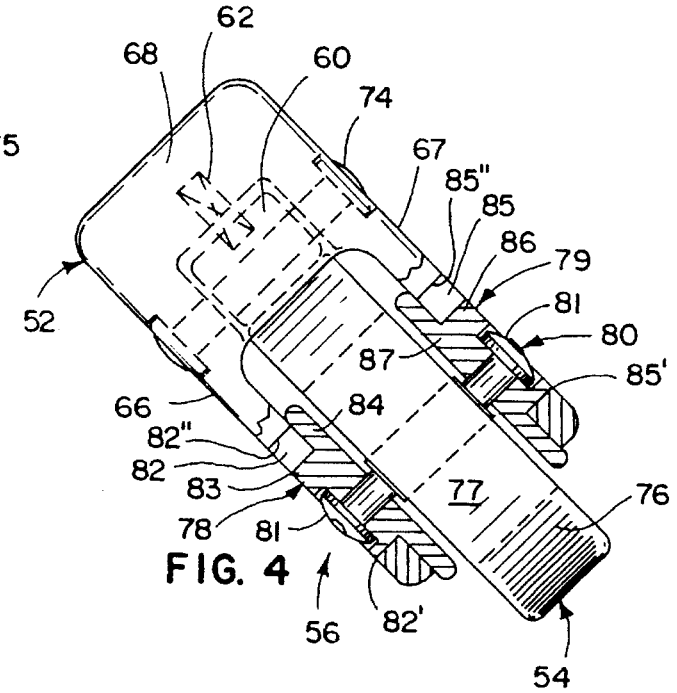
FIG. 4 is a cross-sectional view taken along the lines IV—IV in FIG. 2.
Figure 7:
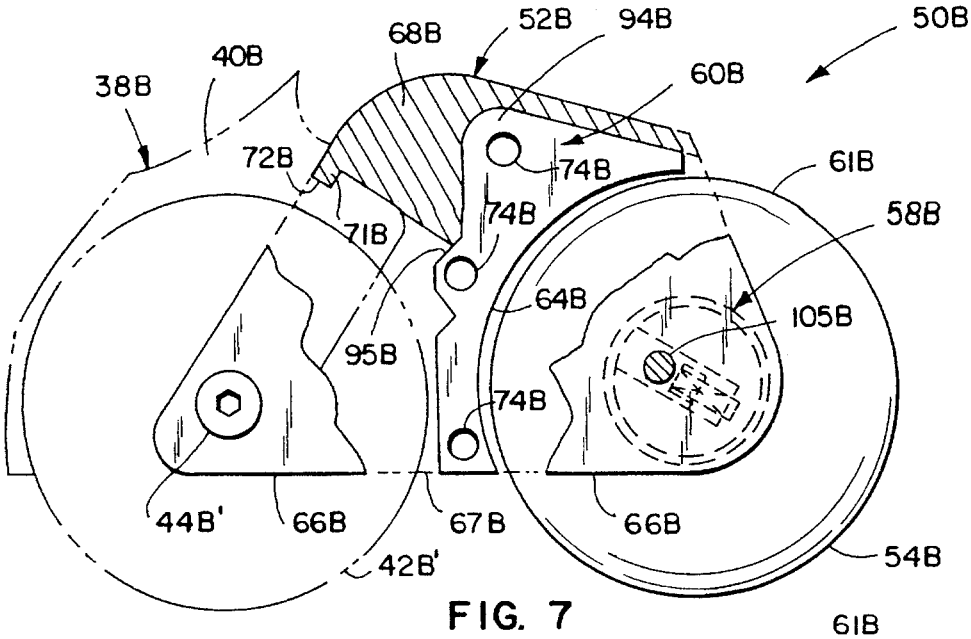
FIG. 7 is an enlarged, fragmentary side view partially in cross section of a modified braking system embodying the present invention.
Figure 8:
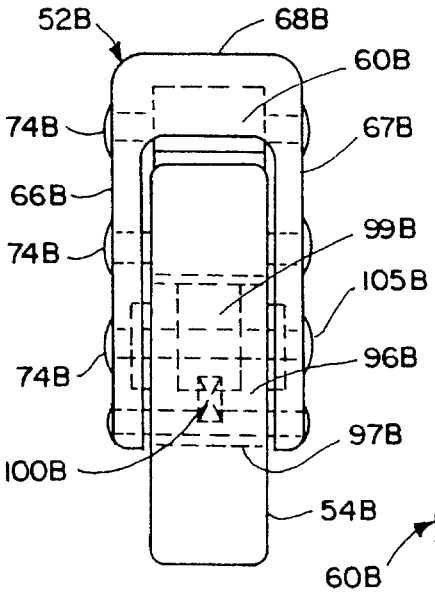
FIG. 8 is a rear view of the braking system shown in FIG. 7.
Figure 9:
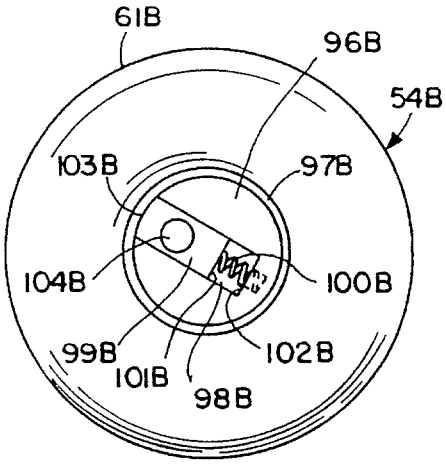
FIG. 9 is a side view of the wheel including the slotted hub, and the slide members shown in FIG. 7.
Figure 10:
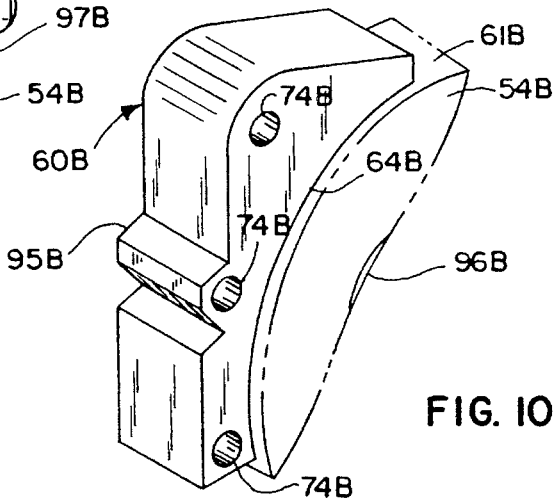
FIG. 10 is a perspective view of the braking pad shown in FIG. 7, the braking wheel being shown in phantom and the extension having been removed to reveal the arrangement of the braking pad and braking wheel.
Figure 11:
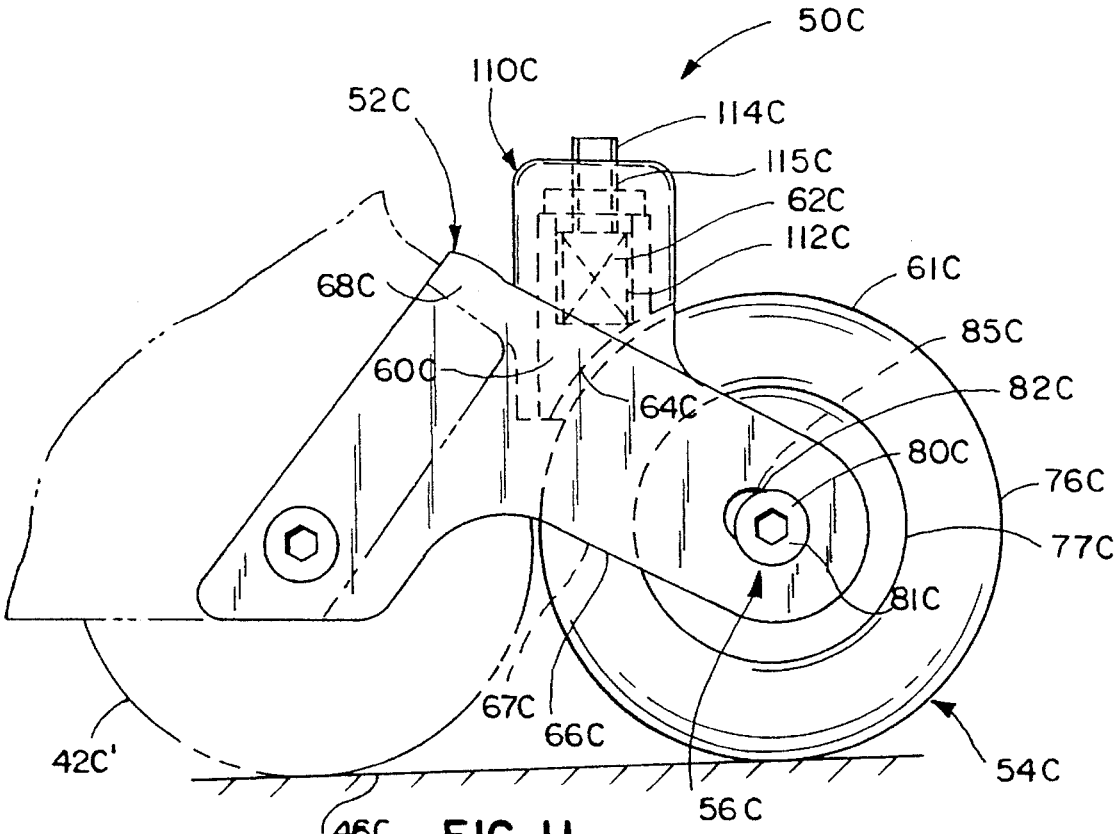
FIG. 11 is an enlarged, fragmentary side view of another braking system embodying the present invention.
Figure 12:
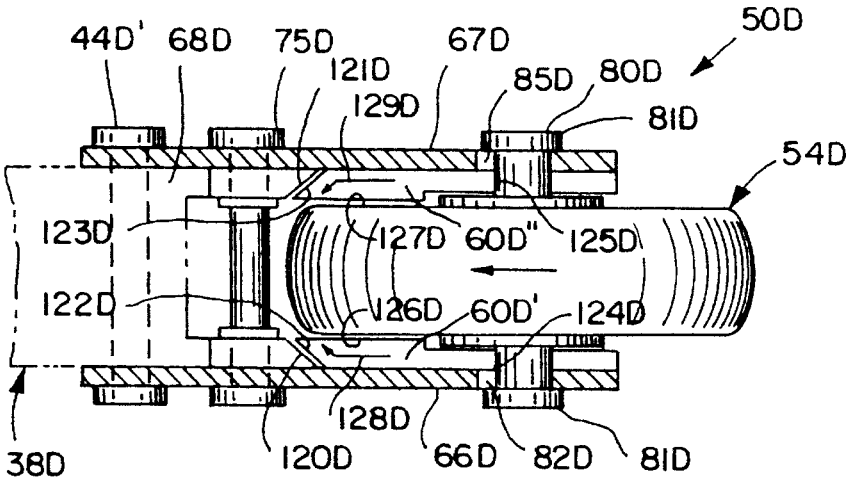
FIG. 12 is an enlarged, fragmentary top view of yet another braking system embodying the present invention.
Figure 13:
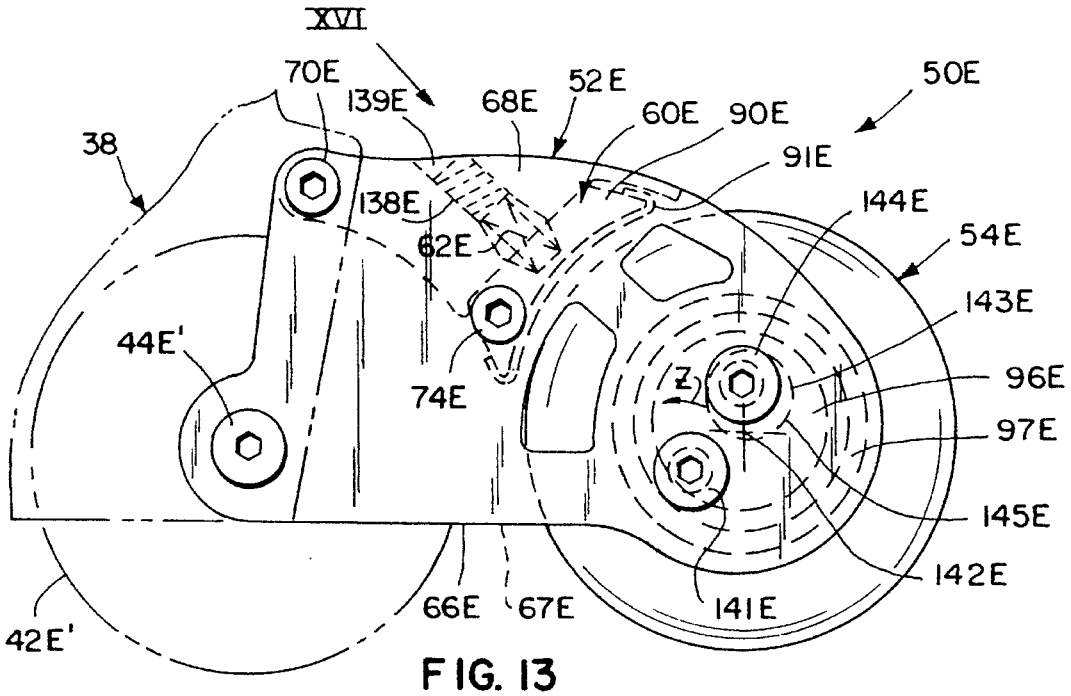
FIG. 13 is an enlarged fragmentary side view of yet another braking system embodying the present invention.
Figure 14:
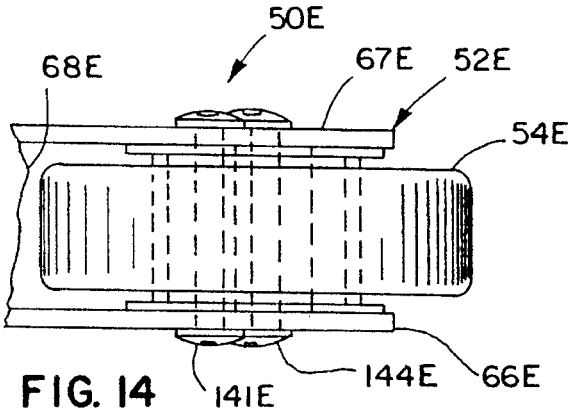
FIG. 14 is a fragmentary top view of the braking system shown in FIG. 13.
Figure 15:
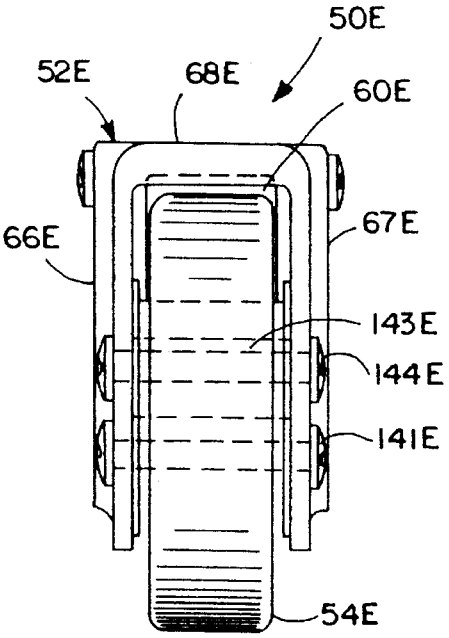
FIG. 15 is a rear view of the braking system shown in FIG. 13.
Figure 16:
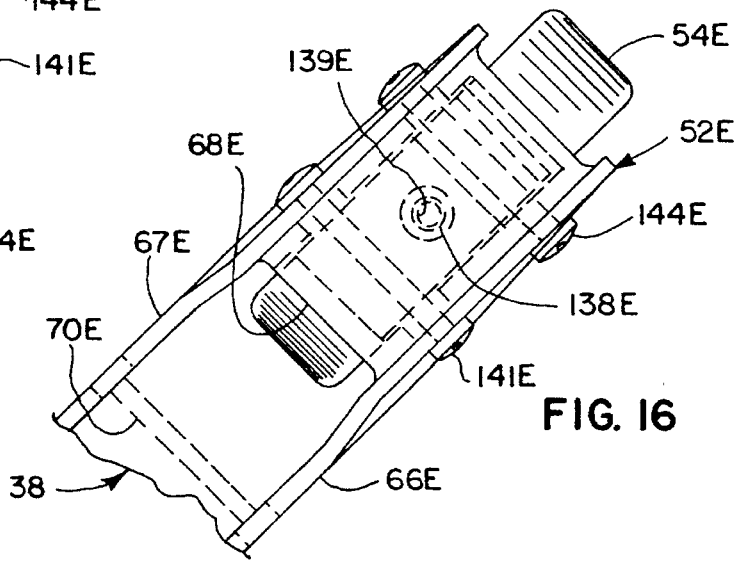
FIG. 16 is a top view taken in the direction of arrow 16 in FIG. 13.

Extension 52 (FIGS. 2–4) is U-shaped and includes opposing side flanges 66 and 67 interconnected by an intermediate transverse section 68. The extension flanges 66 and 67 are spaced apart to mateably engage the outside surfaces of wheel frame flanges 40, and transverse section 68 is configured to mateably engage a tail section 69 on wheel frame flanges 40. The rivet-like axle 44' extends through holes in flanges 66 and 67 and through corresponding holes in wheel frame flanges 40. Also, a tab 71 on transverse section 68 engages a mating notch 72 on tail section 69. Axle 44' and tab 71 fixedly retain extension 52 on wheel-supporting frame 38. Notably, retainer arrangements other than tab 71 and notch 72 can also be used, such as a link connected to the frame 38 or to the cuff support 34, or another fastener.

Brake pad 60 is positioned in the pocket between flanges 66 and 67 under transverse section 68. A rivet-like fastener 74 extends through flanges 66 and 67 and through a hole 75 in brake pad 60 to pivotally support brake pad 60 on extension 52. Transverse section 68 and brake pad 60 define opposing depressions that are generally aligned for receiving coil spring 62. Coil spring 62 is compressed in these depressions and accordingly biases brake pad 60 rotatingly about rivet 74 toward braking wheel 54. Brake pad 60 includes an arcuately shaped surface 64 for engaging the outer surface 61 of braking wheel 54. By engaging outer surface 61 of braking wheel 54, the friction of brake pad 60 on braking wheel 54 operates over a maximum torque arm for maximum braking force on braking wheel 54 while not unnecessarily wearing braking wheel 54.

Braking wheel 54 includes a tire portion 76 and a hub portion 77 fixedly secured to tire portion 76. Support member 56 includes a pair of opposing slide members 78 and 79 (FIG. 6) positioned On opposing sides of hub portion 77 that are retained thereto by the axle 80. Axle 80 includes opposing sections that mateably threadably engage and that include capped ends 81 to retain axle 80 in place once installed in slide members 78 and 79 and braking wheel 54. Roller bearings (not specifically shown) support hub portion 77 on axle 80. Alternatively, a solid lubricated bearing can be used in place of roller bearings. Extension flange 66 includes a slot 82 that extends toward brake pad 60. Slide member 78 includes a rectangular section 83 for slideably engaging slot 82, and a planar section 84 for slideably engaging the inside surface of extension flange 66. Similarly, extension flange 67 includes a slot 85 that extends toward brake pad 60. Also, slide member 79 includes a rectangular section 86 for slideably engaging slot 85 in extension flange 67, and a planar section 87 for slideably engaging the inside surface of extension flange 67. Thus, slide members 78 and 79, braking wheel 54 and axle 80 are adapted to slide as a unit along slots 82 and 85 toward (and away from) brake pad 60. However, spring 62 biases brake pad 60 against braking wheel 54, causing braking wheel 54 to move to the brake-pad-remote ends 82' and 85' of slots 82 and 85.

Figure 2:
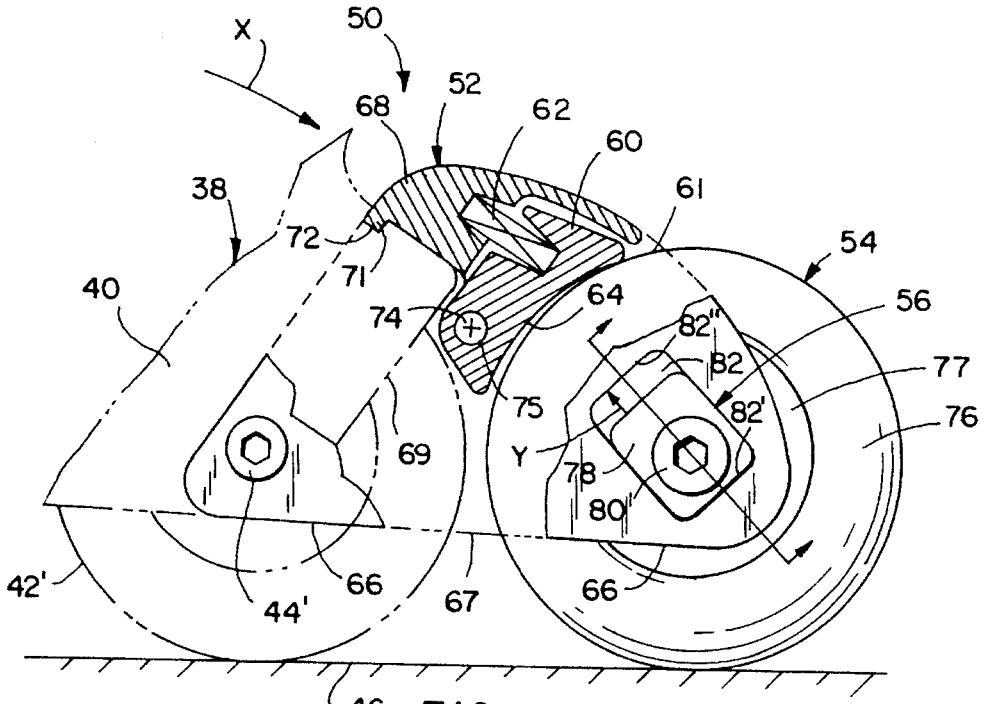
FIG. 2 is an enlarged, fragmentary side view partially in cross section of the braking system shown in FIG. 1.

To apply a braking force to in-line roller skate 30, a skater pivots rearwardly in direction "X" about the rear weight bearing wheel 42' until braking wheel 54 engages skate-supporting surface 46 and begins to roll (FIG. 2). (Compare the relationship of braking wheel 54 and surface 46 in FIGS. 1–2.) The brake pad 60 (FIG. 2) frictionally drags on braking wheel 54 due to the bias of spring 62 which causes brake pad 60 to rotate about rivet 74 into engagement with braking wheel 54. Thus, an initial braking force is created to gradually slow down the speed of the skater. Notably, braking wheel 54 is interchangeable with wheels 42, thus reducing the need for an excessive number of special repair or replacement parts for braking system 50.

As the skater continues to pivot rearwardly an additional angular amount, skating surface 46 presses against braking wheel 54 with sufficient force to cause slide members 78 and 79 to slide along slots 82 and 85, respectively, in direction "Y". This carries braking wheel 54 into increasing frictional engagement with brake pad 60. In turn, spring 62 is compressed by the force on brake pad 60. Thus, the braking force is only gradually increased since brake pad 60, to a certain extent but with increasing resistance, moves with braking wheel 54.

Once slide members 78 and 79 reach the ends 82" and 85" of slots 82 and 85, braking wheel 54 cannot move any farther toward brake pad 60. Thus, the surfaces at the ends of slots 82 and 85 act as stops to limit the movement of braking wheel 54 and thus limit the maximum braking force that braking system 50 can generate. Alternatively, slots 82 and 85 can be designed so that the ends 82" and 85" are never reached by slide members 78 and 79. Notably, by changing the length and spring constant of spring 62, substantially any initial braking force and substantially any load/deflection curve can be obtained by braking system 50. Notably, the movement of braking wheel 54 directly into brake pad 60, and the overall arrangement of braking system 30, provides the skater with an excellent "feel" for the braking force, thus giving the skater excellent control. The arrangement allows axle 80 to "float" in direct response to the skater's movement, thus giving the skater a direct feel for the braking action. The arrangement, and in particular the orientation of slots 82 and 85, provides a mechanical advantage so that the frictional force between the braking wheel 54 and the hard surface 46 is always greater than the force between the brake pad 60 and the braking wheel 54. Thus, there is very little likelihood that braking wheel 54 will lock up and skid, even if the brakes are applied very hard.

Several additional embodiments of roller skates, braking systems and components thereof are shown in FIGS. 6–19. In these embodiments, to reduce redundant discussion, identical or comparable components and features are identified by use of identical numbers as used in describing roller skate 30, but with the addition of the letters "A", "B", "C" and etc.

A modified brake 60A (FIG. 6) includes a backing member or body 90A and a liner 91A. Body 90A is made from a durable, structural material such as a polymer, and brake liner 91A is made from a durable, wear-resistant material such as metal. The ends of liner 91A wrap around and snap lock onto body 90A. Alternatively, liner 91A can be insert molded into body 90A. Body 90A includes a hole 75A for receiving pivot pin 74A, and a depression for receiving an end section of spring 62A.

A modified braking system 50B (FIGS. 7–10) includes an extension 52B having opposing side flanges 66B and 67B interconnected by an intermediate section 68B. Brake pad 60B is fixedly secured to extension 52B by three rivet-like fasteners 74B. Brake pad 60B includes an arcuate surface 64B that extends about 90° around braking wheel outer surface 61B. The upper end 94B of brake pad 60B and a notch 95B on the back of brake pad 60B engage mating surfaces on intermediate flange 68B of extension 52B to fixedly support brake pad 60B.

Support mechanism 56B includes a hub 96B rotatably positioned in a centered hole in braking wheel 54B by roller bearings (not specifically shown, but located at raceway 97B). Hub 96B includes a rectangularly-shaped, radially extending slot 98B. A slide member 99B is slideably positioned in slot 98B, and is biased radially outwardly by a spring 100B that is compressed between the inner end 101B of slide member 99B and the surface 02B of hub 96B forming the end of slot 98B. The outer end 103B of slide member 99B forms a section of the raceway for the roller bearings in raceway 97B. A hole 104B extends through slide member 99B for receiving axle-like fastener 105B.

Braking system 150B provides a stronger, quicker braking action than braking system 30 since a larger braking area is provided on surface 64B for engaging wheel outer surface 61B than on surface 64. Also, brake pad 60B is not moveable and thus less movement of braking wheel 54B is required than with wheel 54. Of course, the load/deflection curve of braking system 50B is dependent upon the spring constant of spring 100B and also on the frictional characteristics of materials used to manufacture brake pad 60B and braking wheel 54B. To operate braking system 50B, the skater pivots rearwardly on rear weight-supporting wheel 42B', causing braking wheel 54B and hub 96B to slide on slide member 99B toward brake pad 60B such that braking wheel 54B engages brake pad 60B.

Braking system 50C (FIG. 11) includes an extension 52C having slots 82C and 85C in extension flanges 66C and 67C. An axle 80C extends through and rotatably engages hub 77C to support braking wheel 54C. Axle 80C further extends through slots 82C and 85C, thus forming slide mechanism 56C. Capped ends 81C on axle 56C retain axle 56C in extension 52C. Axle 80C is slideable in slots 82C and 85C, and thus braking wheel 54C moves along slots 82C and 85C as roller skate 30C is pivoted rearwardly about rear wheel 42' and skate-supporting surface 46C presses on braking wheel 54C.

A stanchion 110C extends above intermediate section 68C. Stanchion 110C defines a generally vertically oriented pocket for slideably receiving a brake pad 60C. Brake pad 60C includes an arcuate surface 64C for engaging the outer surface 61C of braking wheel 54C. A spring 62C is positioned in a depression 112C in the top 113C of brake pad 60C. An adjustment screw 114C extends through a threaded hole 115C in the top of stanchion 110C. By adjusting screw 114C, the compression of spring 62C can be adjusted, and thus the braking force (i.e. the preload and also the load/deflection curve) can be adjusted. Notably, brake pad 60C is oriented generally tangentially to the outer surface 61C of braking wheel 54C in the direction of rotation of braking wheel 54C when it rollingly engages surface 46C. Due to the orientation of braking pad 60C, the frictional braking force between brake pad 60C and braking wheel 54C tends to draw brake pad 60C into increasing engagement, and thus the braking force is "artificially" amplified.

In the braking system 50D (FIG. 12), intermediate section 68D of extension 52D includes opposing ramps 120D and 121D adjacent the insides of opposing flanges 66D and 67D, respectively. An axle 80D rotatably supports braking wheel 54D, and further slideably engages slots 82D and 85D in extension flanges 66D and 67D. Capped ends 81D retain axle 80D in extension 52D. In braking system 50D, a pair of opposing brake pads 60D' and 60D" are located between the sides of braking wheel 54D and extension flanges 66D and 67D, respectively. Ramps 122D and 123D are located on brake pads 60D' and 60D" proximate section ramps 120D and 121D. Axle 80D extends through holes 124D and 125D on brake pads 60D' and 60D", respectively. As roller skate 30D is pivoted rearwardly, braking wheel 54D rollingly engages skate-supporting surface 46D and is moved toward roller skate 30D. This causes axle 80D to slide along slots 82D and 85D. Axle 80D engages opposing brake pad 60D' and 60D", and also causes them to slide along the inside of extension flanges 66D and 67D. As brake pad ramps 122D and 123D engage extension ramps 120D and 121D, brake pads 60D' and 60D" move at an angle along paths 128D and 129D, and bind against the sides 126D and 127D of braking wheel 54D.

An advantage of braking system 50D is that brake pads 60D' and 60D" do not brake against the outer surface 61D of braking wheel 54D, but rather brake against wheel sides 126D and 127D which are, relatively clean. Further, the outside diameter (61D) of braking wheel 54D does not change even if sides 126D and 127D wear. Another advantage is that a braking wheel 54D can be used that is interchangeable with the other wheels (e.g. wheels 42) on the roller skate 30D. Notably, a fastener 75D extends through extension flanges 66D and 67D proximate extension ramps 120D and 121D at the points, of highest stress. Thus, the strength of the design is not mechanically degraded by cyclical loading over time. Notably, the angle of ramps 120D–123D can be varied to achieve a particular load/deflection curve for the braking system 50D.

Figure 6:
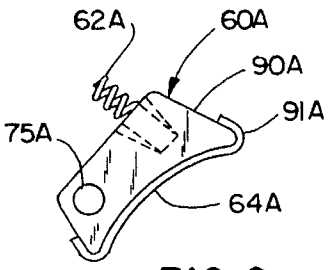
FIG. 6 is a side view of a modified brake pad.

Braking system 50E (FIGS. 13–6) includes an extension 52E secured to wheel-supporting frame 38 by rear wheel axle 44E' and by rivet-like fastener 70E. Brake pad 60E is secured under intermediate section 68E by a rivet-like fastener 74E which pivotally retains brake pad 60E to extension 52E. A spring 62E seated in a depression in intermediate section 68E and biases brake pad 60E about fastener 74E into engagement with braking wheel 54E. Brake pad 60E includes a body 90E and a brake liner 91E, not unlike brake pad 60B (FIG. 6). An adjustment screw 138E engages spring 62E for adjusting the tension on brake pad 60E. Also, threaded passageway 139E provides a passageway for, removal of spring 62E such as for replacing spring 62E. Apertures 140E in extension flanges 66E and 67E allow movement of air around brake pad 60E to cool brake pad 60E. Also, apertures 140E reduce the weight of the overall system, and also provide aesthetics.

A hub 96E (FIG. 13) is rotatably supported in braking wheel 54E by roller bearings or a solid bearing located along raceway 97E. An axle-like fastener 141E extends through hub 96E and rotatably supports hub 96E at a location spaced from the axis of rotation 142E for braking wheel 54E. Fastener 141E securely engages extension flanges 66E and 67E. An oversized aperture 143E is located in hub 96E offset from axis 142E and fastener 141E. A second fastener 144E extends through aperture 143E and is securely attached to extension flanges 66E and 67E. As braking wheel 54E engages skate-supporting surface 46E, braking wheel 54E is biased toward brake pad 60E. This causes hub 96E to pivot in direction "Z", which causes braking wheel 54E to move toward brake pad 60E. The rotation of hub 96E is limited (i.e. stopped) by the engagement of second fastener 144E with the side 145E of aperture 143E. Hub 96E and the related components 141E, 143E and 144E form slide mechanism 56E. The translating sliding motion of the mechanism is an arcuate motion as shown by arrow "Z", as opposed to a linear motion of the slide mechanisms shown in FIGS. 1–12.

Braking system 50F (FIGS. 17–18) includes an extension 52F pivotally connected to wheel-supporting frame 38F at the rear axle 44F' of rear skate wheel 42F'. The brake pad 60F and braking wheel 54F are substantially identical to brake pad 60E and braking wheel 54E in FIGS. 13–16. However, a cuff actuated link 148F is pivotally connected at one end to extension 52F at protrusion 149F and is pivotally connected at its other end to cuff support 34F at protrusion 150F. In addition to the movement of braking wheel 54F toward braking pad 60F, cuff actuated link 148F causes extension 52F and brake pad 60 to pivot about rear axle 44F' toward braking wheel 54F when the skater leans rearwardly on in-line skate 30F. Also, the forces generated on the ankle of the skater by link 148F gives the skater an excellent "feel" or sensitivity to the braking force being generated.

Figure 17:
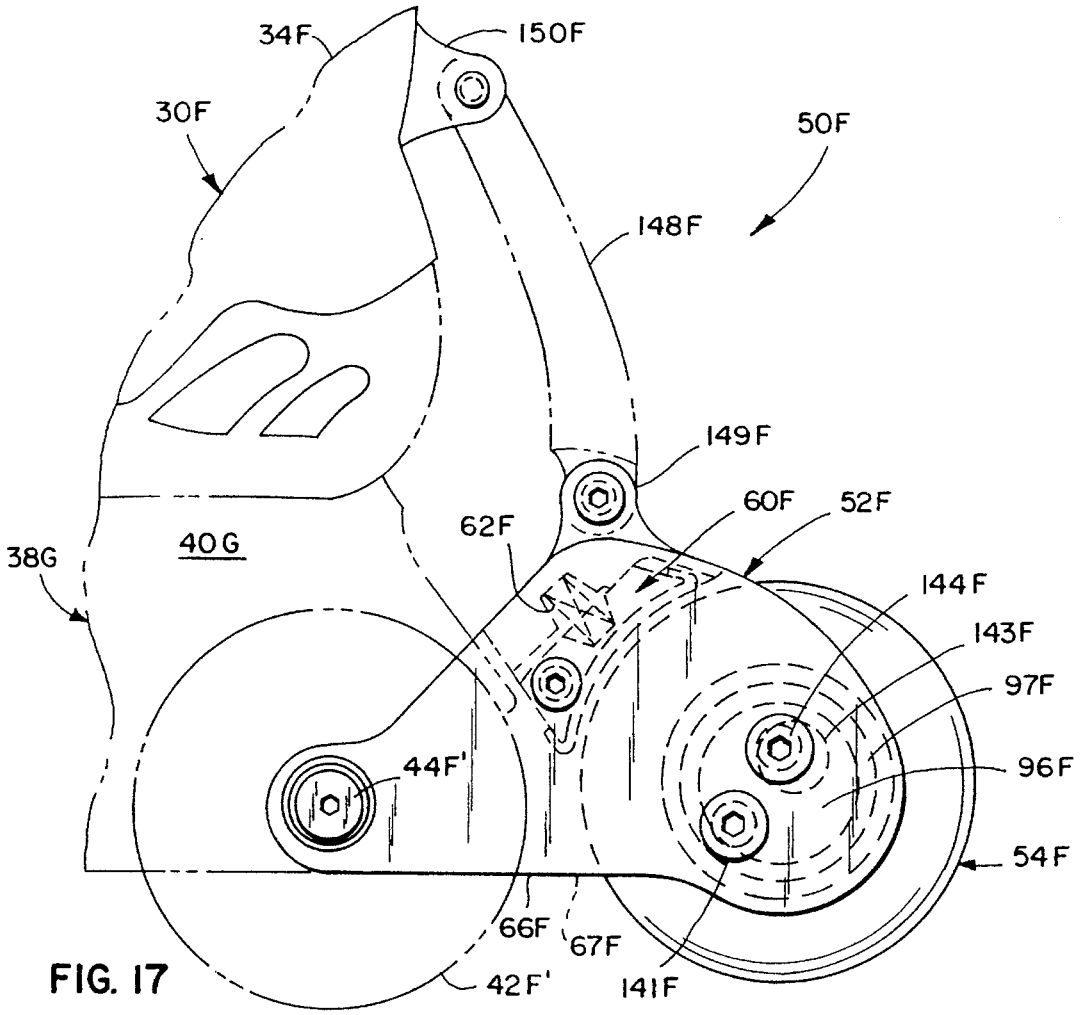
FIG. 17 is an enlarged, fragmentary side view of yet another braking system embodying the present invention.
Figure 19:
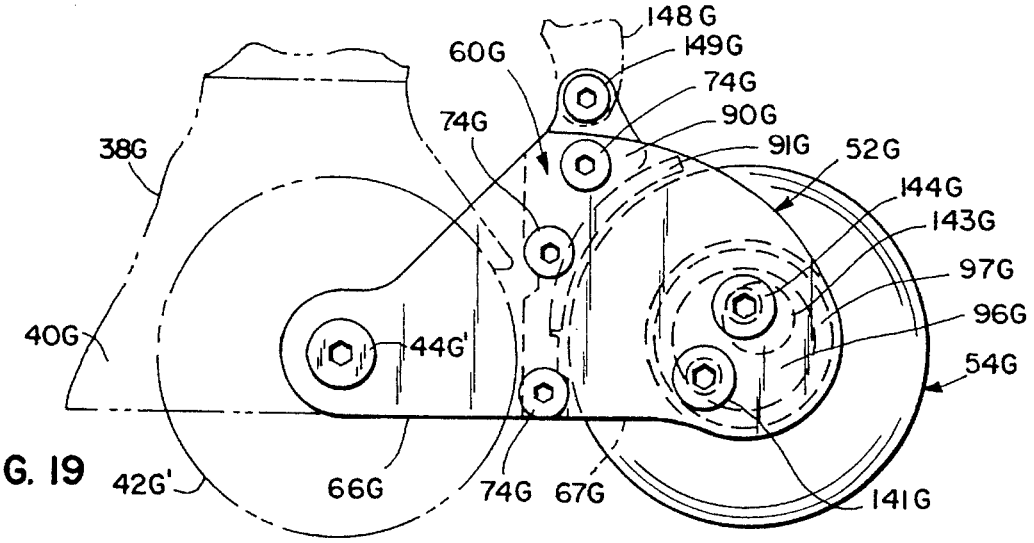
FIG. 19 is an enlarged, fragmentary side view of yet another braking system embodying the present invention.

Braking system 50G (FIG. 19) includes an extension 52G pivotally connected to wheel-supporting frame 38G that is comparable to extension 52F in FIG. 17. Also, cuff actuated link 148G and braking wheel 54G including hub 96G (FIG. 19) are comparable to link 148F and braking wheel 54F including hub 96F (FIG. 17). However, a brake pad 60G (FIG. 19) is used that is fixedly secured to extension flanges 66G and 67G by three rivet-like fasteners 74G. (Compare to FIG. 7.) Notably, brake pad 60G includes a body 90G and a brake liner 91G for increased durability.

Figure 20:
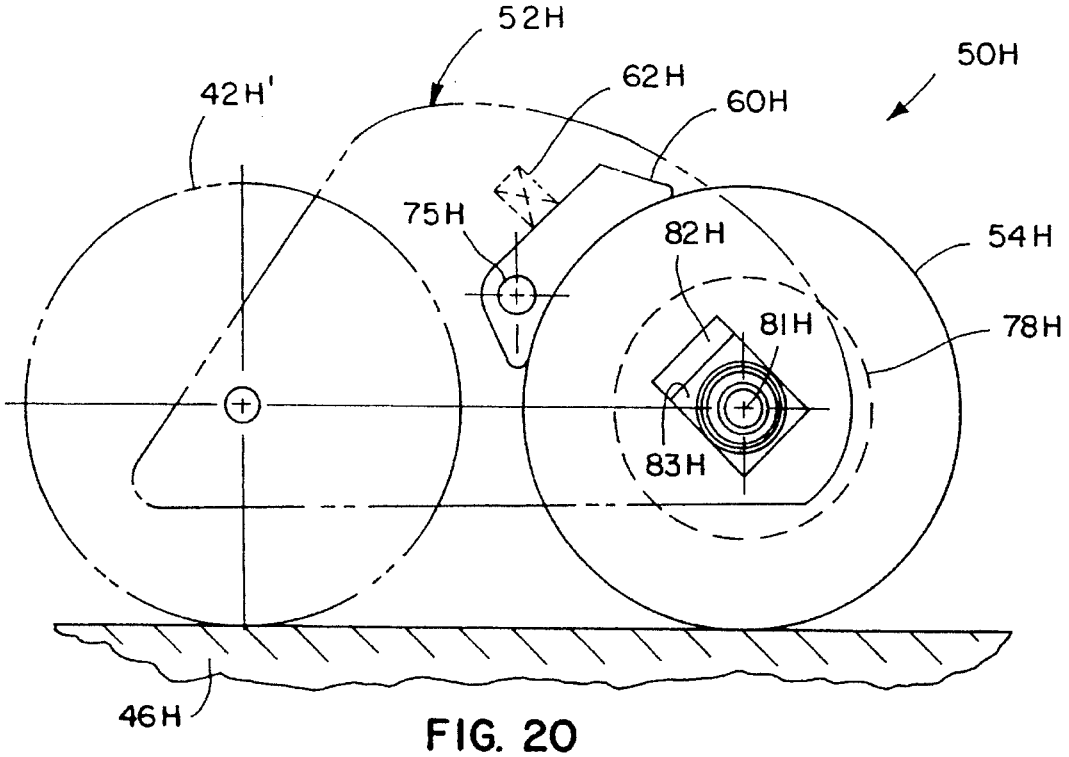
FIG. 20 is a fragmentary side view of another braking system embodying the present invention.
Figure 21:
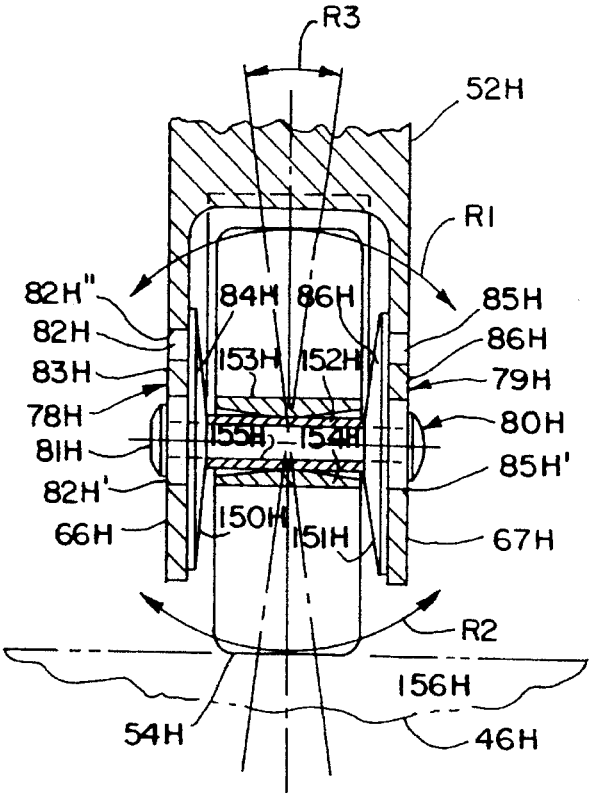
FIG. 21 is a rear end view of the braking system shown in FIG. 20.
Figure 22:
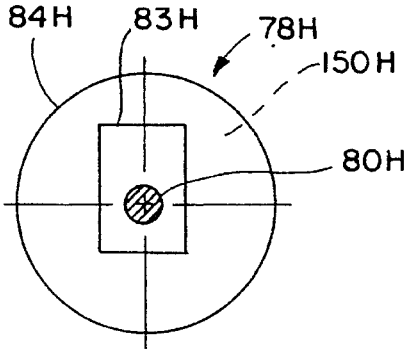
FIG. 22 is a side view of the slide member shown in FIGS. 20 and 21.

Braking system 50H (FIGS. 20–22) is closely related to braking system 50 (FIG. 2), except that braking system 50H has been modified to allow braking wheel 54H to pivot from side-to-side as shown by arrows R1 and R2 in FIG. 21. The angle of rotation is indicated by angle R3. Specifically, extension 52H, brake shoe 60H and brake wheel 54H (FIGS. 20–22) are identical to extension 52, brake shoe 60 and brake wheel 54 (FIG. 2). Additionally, slide members 78H and 79H (FIGS. 20–22) are similar to slide members 78 and 79 (FIG. 2). Specifically, slide member 78H further includes a rectangular section 83H for engaging slot 82H in extension flange 66H and a "planar" section or slide washer 84H for engaging the inside surface of flange 66H. However, "planar" section 84H includes a tapered inner surface 150H. Also, slide member 79H includes rectangular section 86H for engaging extension flange slot 85H, and a "planar" section 87H for engaging the inside surface of flange 67H. However, "planar" section 86H includes a tapered inner surface 151H.

A sleeve 152H is mounted on braking wheel axle 80H and a bearing 153H having a double outwardly tapered hole 154H is positioned on sleeve 152H. The double outwardly tapered hole 154H creates a fulcrum at the center 155H of bearing 153H along the central plane 156H of braking wheel 54H. Bearing 153H can pivot on fulcrum point 155H such that braking wheel 54H is allowed an excursion out of plane 156H by the angle R3. In other words, braking wheel 54H can pivot along paths R1/R2 until the axle 80H engages the tapered hole 154H and prevents further rotation. The taper in surfaces 150H and 15111 of slide members 78H and 79H allow the braking wheel 54H to pivot the amount of angle R3 without resistance.

The angular movement of braking wheel 54H as shown by arrows R1 and R2 allows braking wheel 54H to engage skate-supporting surface 46H at a perpendicular angle to ground surface 46H even though the in-line roller skate 30H is oriented at an angle to ground surface 46H when the skater is applying the brakes. This advantageously allows maximum contact between braking wheel 54H and ground surface 46H. Thus, braking wheel 54H is not likely to skid or slide. Notably, brake pad 60H engages braking wheel 54H and biases it back to an aligned "vertical" position in extension 52H.

It is noted that various features in the embodiments can be combined, and that not all possible combinations are shown herein. For example, the cuff actuated feature shown in FIG. 17 could be combined with the brake pad and brake wheel/support mechanism shown in FIG. 7. These variations and combinations are also contemplated to be within the scope of the present invention.

Thus, in-line roller skaters are provided with braking systems that include a brake pad and a "floating" braking wheel slideably supported on a wheel frame extension. The sliding response of the braking wheel to engagement with a skate-supporting surface and the direct "floating" movement of the braking wheel into the brake pad gives improved control over braking and an improved feel for braking.

While the preferred embodiments of the present invention have been described, it should be understood that various changes, adaptations, combinations, and modifications may be made therein without departing from the spirit of the invention and the scope of the appended claims.

The embodiments of the invention in which an exclusive property or privilege is claimed are defined as follows:

1. A braking system for an in-line roller skate including a wheel-supporting frame, and a plurality of aligned wheels operably supported by the wheel-supporting frame adapted to rollingly engage a skate-supporting surface, comprising:

an extension member connoted to the wheel-supporting frame and extending rearwardly therefrom;

a brake pad pivotally supported by said extension;

a braking wheel generally in alignment with the plurality of aligned wheels, a spring for biasing said brake pad in a direction against said braking wheel and for maintaining said brake pad in continuous engagement with said braking wheel, said braking wheel being normally spaced above said skate supporting surface and positioned to rollingly engage the skate-supporting surface only when the roller skate is pivoted rearwardly; and a support mechanism including a slide member for rotatably supporting said braking wheel, said slide member slidably engaging at least one slot in said extension member, wherein said slide member and said braking wheel are movable relative to said extension member, against the force of said spring, for generating a braking force when the in-line roller skate is tilted rearwardly and said braking wheel engages the skate-supporting surface, the braking force increasing upon increased rearward tilting of the roller skate.

2. A braking system as defined in claim 1 wherein said braking wheel is interchangeable with one of said plurality of aligned wheels.

3. A braking system as defined in claim 1 wherein said extension includes opposing flanges positioned on opposing sides of said braking wheel, and said at least one slot includes a pair of slots that extend into said opposing flanges of said extension adjacent said braking wheel.

4. A braking system as defined in claim 3 wherein each of said slots extends through said opposing flanges on said extension.

5. A braking system as defined in claim 1 including a surface on said extension that forms a stop that limits the movement of said slide member.

6. A braking system as defined in claim 1 including an adjustment screw for adjusting the biasing force of said spring on said brake pad,

7. A braking system as defined in claim 1 wherein said plurality of aligned wheels includes at least four aligned wheels.

8. A braking system as defined in claim 1 wherein said extension is configured to be retrofittably attached to said frame.

9. A braking system as defined in claim 1 wherein said extension is fixedly secured to said frame.

10. A braking system as defined in claim 1 wherein said extension includes a hub that defines said slot and also rotatably supports said braking wheel, said hub being rotatable about a first axis of rotation and said braking wheel being rotatable about a second axis of rotation that is offset from said first axis.

11. A braking system as defined in claim 10 wherein said hub includes an oversized aperture spaced from said axle-receiving hole and spaced from said axis, and including a rotation-limiting fastener extending through said oversized aperture for limiting the rotation of said hub, whereby said braking wheel moves toward or away from said braking pad as said hub is rotated about said first axis.

12. A braking system as defined in claim 1 including a cuff actuated link operably connected to said extension for moving said brake pad relative to said braking wheel to selectively increase the braking force generated by the braking wheel.

13. A braking system as defined in claim 1 wherein said extension is pivotally connected to said wheel frame, and including a link connected between said extension and said skate for moving said extension and in turn moving said braking wheel into engagement with said skate-supporting surface, whereby said braking wheel is urged against said brake pad to generate a braking force.

14. A braking system as defined in claim 1 wherein said brake pad includes a polymeric backing member and a relatively thin blake lining covering the wheel-engaging side of the polymeric backing member.

15. A braking system as defined in claim 1 wherein said brake pad defines an arcuate segment extending about 90° around said brake wheel.

16. A braking system as defined in claim 1 wherein said brake pad includes opposing brake pad members configured to frictionally engage opposing sides of said braking wheel.

17. A braking system as defined in claim 1 wherein said extension includes opposing flanges, and said slide member includes opposing slide halves located between said opposing flanges, said opposing slide halves and said opposing brake pads including mating ramps that engage and cause said opposing brake pads to ramp against the sides of said braking wheel as said braking wheel is moved between said various braking positions by the force of contact with said skate-supporting surface.

18. A braking system as defined in claim 1 wherein said plurality of aligned wheels define a generally vertical plane, and wherein said support mechanism includes an axle for rotatably supporting said braking wheel and further includes an axle-engaging sleeve secured to said braking wheel that rotatably engages said axle, one of said axle and said axle-engaging sleeve defining a tapered surface for engaging a corresponding surface on the other of said axle and said sleeve, said tapered surface defining a centered fulcrum such that said braking wheel is adapted to pivot out of said generally vertical plane to more securely engage the skate-supporting surface when a skater is braking on said braking wheel.

19. A braking system for an in-line roller skate including a wheel-supporting frame, and a plurality of aligned wheels operably supported by the wheel-supporting frame adapted to rollingly engage a skate-supporting surface, comprising:

an extension member connected to the wheel-supporting frame and extending rearwardly therefrom;

a brake pad pivotally supported by said extension;

a braking wheel generally in alignment with the plurality of aligned wheels, biasing means for forcing said brake pad in a direction against said braking wheel and for maintaining said bake pad in continuous engagement with said braking wheel, said braking wheel being normally spaced above said skate-supporting surface and positioned to rollingly engage the skate-supporting surface only when the roller skate is pivoted rearwardly; and a support mechanism including a slide member for rotatably supporting said braking wheel, said slide member slidably engaging at least one slot in said extension member, wherein said slide member and said braking wheel are movable relative to said extension member, against the force of said biasing means, for generating a braking force when the in-line roller skate is tilted rearwardly and said braking wheel engages the skate-supporting surface, the braking force increasing upon increased rearward tilting of the roller skate.

20. A braking system as defined in claim 19 including a surface on said extension that forms a stop that limits the movement of said slide member.

21. A braking system as defined in claim 19 wherein said brake pad includes a section in continuous engagement with said braking wheel that acts as a wiper on said braking wheel.

22. A braking system as defined in claim 19 including an adjustment screw for adjusting the biasing force of said biasing means on said brake pad.

23. A braking system as defined in claim 19 wherein said extension includes a hub that defines said slot and also rotatably supports said braking wheel, said hub being rotatable about a first axis of rotation and said braking wheel being rotatable about a second axis of rotation that is offset from said first axis.

24. A braking system as defined in claim 19 including a cuff actuated link operably connected to said extension for moving said brake pad relative to said braking wheel to selectively increase the braking force generated by the braking wheel.

25. A braking system as defined in claim 19 wherein said extension is pivotally connected to said wheel frame, and including a link connected between said extension and said skate for moving said extension and in turn moving said braking wheel into engagement with said skate-supporting surface, whereby said braking wheel is urged against said brake pad to generate a braking force.

26. A braking system as defined in claim 19 wherein said brake pad includes a polymeric backing member and a relatively thin brake lining covering the wheel-engaging side of the polymeric backing member.

* * * * *

UNITED STATES PATENT AND TRADEMARK OFFICE

CERTIFICATE OF CORRECTION

PATENT NO. : 5,511,803
DATED : April 30, 1996
INVENTOR : Edward O. Klukos

It is certified that error appears in the above-identified patent and that said Letters Patent is hereby corrected as shown below:

Column 5, line 23;
"On" should be –on–.

Column 6, line 60;
"02B" should be –102B–.

Column 8, line 12;
"(Figs. 13-6)" should be –(Figs. 13-16)–.

Column 10, claim 1, line 10;
"connoted" should be –connected–.

Column 11, claim 14, line 18;
"blake" should be –brake–.

Signed and Sealed this

Nineteenth Day of November, 1996

*Attest:*

Bruce Lehman

BRUCE LEHMAN

*Attesting Officer*

*Commissioner of Patents and Trademarks*